US011822281B2

(12) United States Patent
Sanekata et al.

(10) Patent No.: US 11,822,281 B2
(45) Date of Patent: Nov. 21, 2023

(54) SENSOR CLEANING DEVICE AND IMAGE FORMING APPARATUS

(71) Applicant: FUJIFILM Business Innovation Corp., Tokyo (JP)

(72) Inventors: Keiji Sanekata, Kanagawa (JP); Chihiro Hagiwara, Kanagawa (JP); Kiyoshi Sako, Kanagawa (JP); Kento Terashima, Kanagawa (JP); Masayuki Shimoda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/948,235

(22) Filed: Sep. 20, 2022

(65) Prior Publication Data

US 2023/0305479 A1 Sep. 28, 2023

(30) Foreign Application Priority Data

Mar. 22, 2022 (JP) ..... 2022-046008

(51) Int. Cl.
*G03G 21/00* (2006.01)
*G03G 15/00* (2006.01)

(52) U.S. Cl.
CPC ..... *G03G 21/0011* (2013.01); *G03G 15/5041* (2013.01); *G03G 2221/0063* (2013.01)

(58) Field of Classification Search
CPC ..... G03G 15/05041; G03G 15/5058; G03G 21/00
USPC ..... 399/61, 64, 74, 350
See application file for complete search history.

(56) References Cited

U.S. PATENT DOCUMENTS 7,366,437 B2 4/2008 Inui et al.
8,725,027 B2 * 5/2014 Goto ..... G03G 15/5058 399/99

FOREIGN PATENT DOCUMENTS

JP H096203 1/1997
JP 2006215203 8/2006
JP 5100897 12/2012

* cited by examiner

*Primary Examiner* — Hoan H Tran
(74) *Attorney, Agent, or Firm* — JCIPRNET

(57) ABSTRACT

A sensor cleaning device includes: a cleaning member including an inclined portion that wipes and cleans an entire surface of a sensor, which includes a long side portion extending in a longitudinal direction and a short side portion extending in a lateral direction intersecting with the longitudinal direction, while moving relative to the surface of the sensor in the longitudinal direction of the surface of the sensor and is disposed obliquely to a wiping direction so that an upstream end portion of the inclined portion in the wiping direction is positioned outside the surface of the sensor in the lateral direction; and a moving mechanism that moves the cleaning member in the wiping direction and in a direction opposite to the wiping direction.

14 Claims, 11 Drawing Sheets

SENSOR CLEANING DEVICE AND IMAGE FORMING APPARATUS

CROSS-REFERENCE TO RELATED APPLICATIONS

This application is based on and claims priority under 35 USC 119 from Japanese Patent Application No. 2022-046008 filed Mar. 22, 2022.

BACKGROUND

(i) Technical Field

The present invention relates to a sensor cleaning device and an image forming apparatus.

(ii) Related Art

An image forming apparatus, which causes a cleaning member to reciprocate (slide) to clean the surface (detection surface) of a sensor, has been known in the related art (for example, see JP2006-215203A).

SUMMARY

Aspects of non-limiting embodiments of the present disclosure relate to a sensor cleaning device and an image forming apparatus that can suppress re-adhesion of foreign matters to a surface of a sensor in a case where a cleaning member passes through the surface of the sensor and returns to an original position as compared to a case where a cleaning member moves foreign matters only in a wiping direction to clean a surface of a sensor in a sensor cleaning device of which the cleaning member wipes the surface of the sensor and returns to an original position.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a sensor cleaning device including: a cleaning member including an inclined portion that wipes and cleans an entire surface of a sensor, which includes a long side portion extending in a longitudinal direction and a short side portion extending in a lateral direction intersecting with the longitudinal direction, while moving relative to the surface of the sensor in the longitudinal direction of the surface of the sensor and is disposed obliquely to a wiping direction so that an upstream end portion of the inclined portion in the wiping direction is positioned outside the surface of the sensor in the lateral direction; and a moving mechanism that moves the cleaning member in the wiping direction and in a direction opposite to the wiping direction.

BRIEF DESCRIPTION OF THE DRAWINGS

Exemplary embodiment(s) of the present invention will be described in detail based on the following figures, wherein.

DETAILED DESCRIPTION

Figure 1:
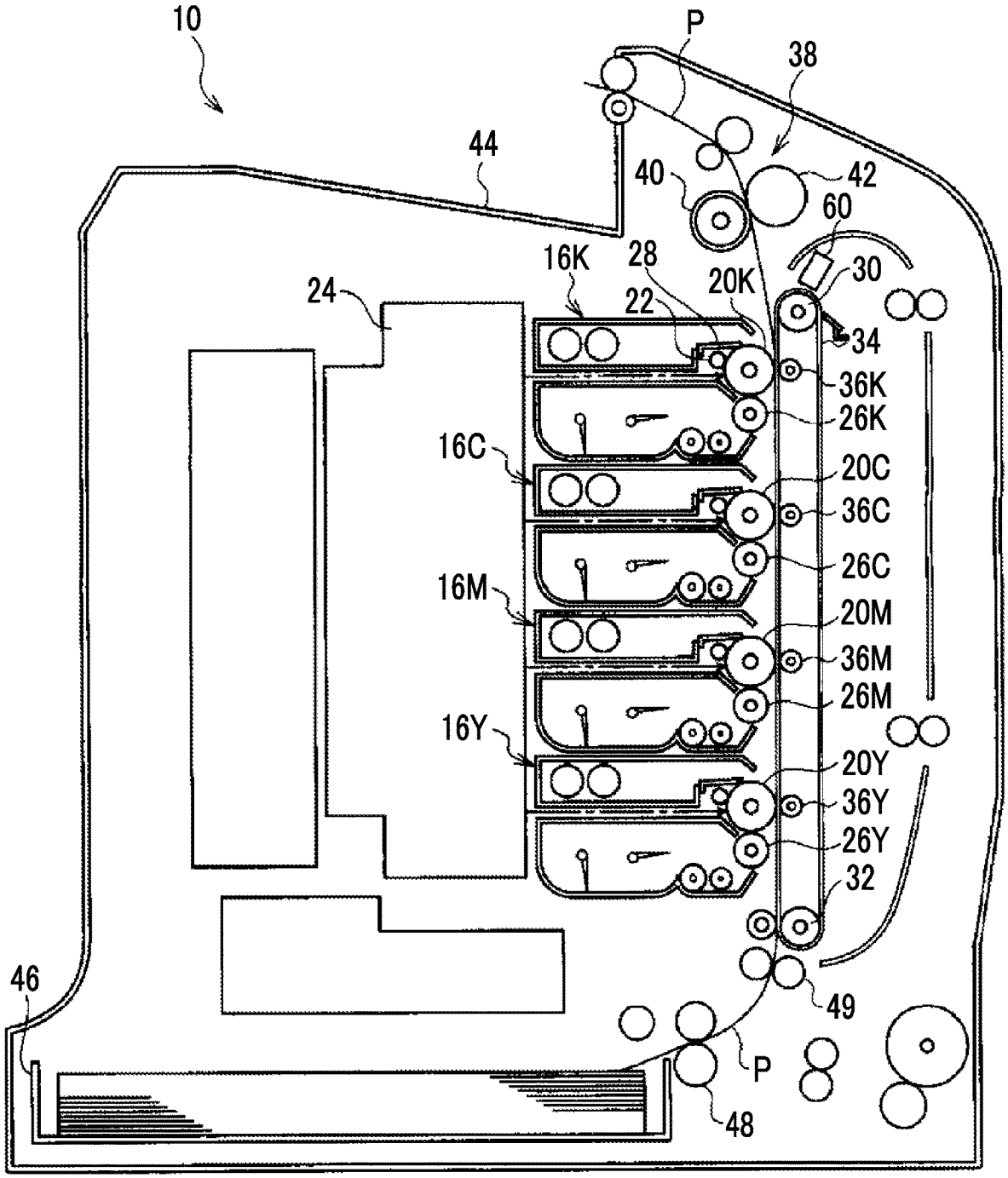
FIG. 1 is a schematic side view showing a configuration of an image forming apparatus according to the present exemplary embodiment.

Exemplary embodiments of the present invention will be described in detail below with reference to the drawings. In each drawing, alphabetic characters of "Y", "M", "C", and "K" may be given after reference numerals with regard to components arranged for the respective colors of yellow (Y), magenta (M), cyan (C), and black (K).

Figure 2:
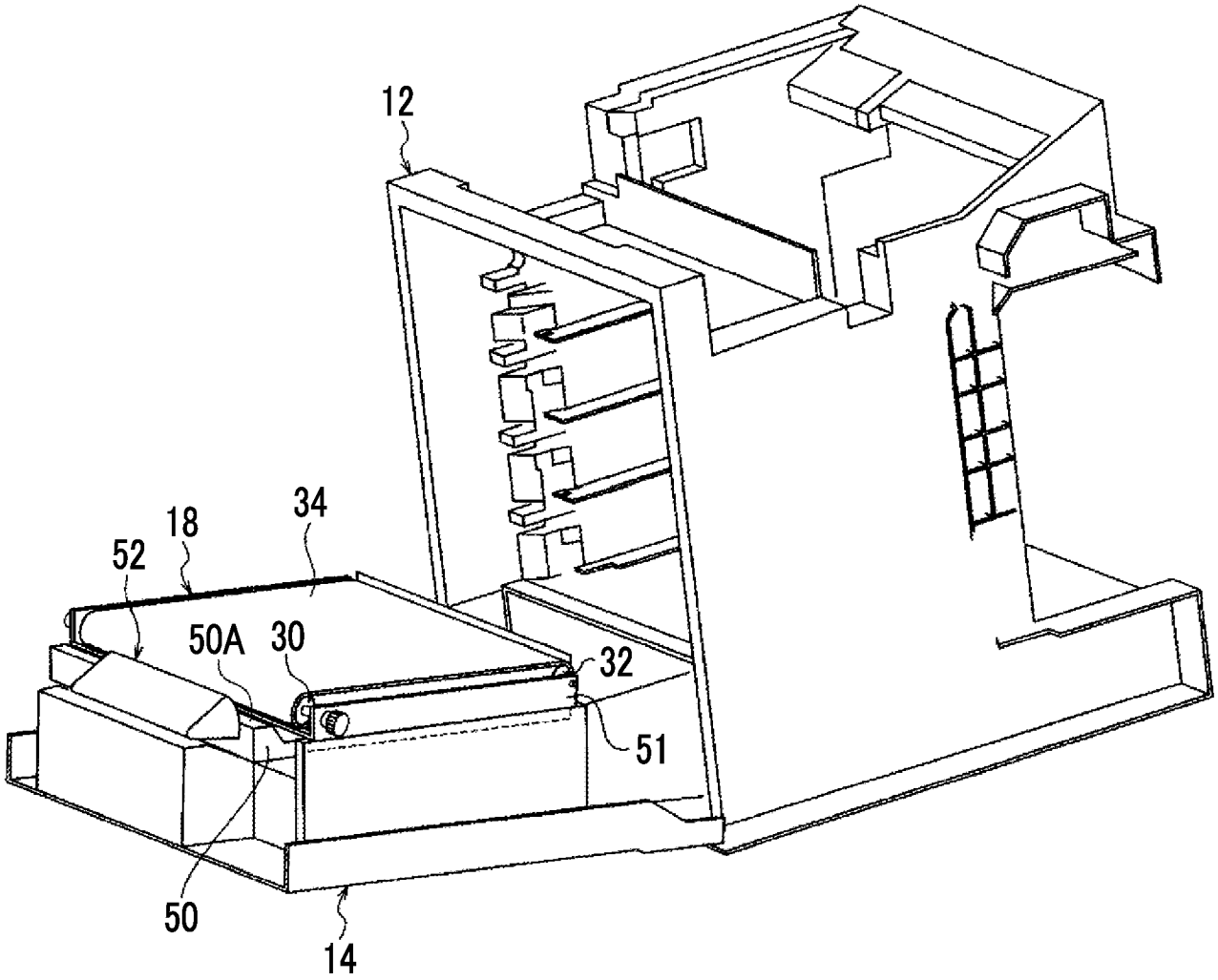
FIG. 2 is a schematic perspective view showing a cover body on which a transport unit of the image forming apparatus according to the present exemplary embodiment is mounted and a body frame.

First, the outline of an image forming apparatus 10 according to a present exemplary embodiment will be described. As shown in FIGS. 1 and 2, the image forming apparatus 10 includes a body frame 12 in which photoreceptors 20 and developing units 16 are attachably and detachably housed and a cover body 14 that opens and closes the photoreceptors 20 and the developing units 16, and a transport unit 18 including a transport belt 34, which can attract and transport a recording sheet P, is attachably and detachably mounted on the cover body 14.

The developing unit 16 includes a charging roller 22 that uniformly charges the surface (outer peripheral surface) of a roller-shaped photoreceptor 20, an optical box 24 that irradiates the photoreceptor 20 with image light on the basis of image data and forms a latent image depending on an electrostatic potential difference, a developing roller 26 that selectively transfers toner to the latent image to visualize the latent image, and a cleaning member 28 that is in sliding contact with the photoreceptor 20 to which a toner image has been transferred and removes the toner remaining on the photoreceptor 20.

The photoreceptor 20 includes a photoreceptor layer on the surface thereof, and is adapted so that the surface of the photoreceptor 20 is uniformly charged by the charging roller 22 and is then exposed to laser light (image light) emitted from the optical box 24 and an electrostatic latent image (image) is formed through the attenuation of the potential of an exposed portion. The charging roller 22 is in contact with the photoreceptor 20, and is adapted to substantially uniformly charge the surface of the photoreceptor 20 in a case where a voltage is applied between the charging roller 22 and the photoreceptor 20 and electric discharge is generated in a minute gap near a contact portion.

The optical box 24 is adapted to scan the surface of the photoreceptor 20 with flickering laser light to form an electrostatic latent image, which is based on the image data, on the surface of the photoreceptor 20. A unit in which light emitting elements, such as LEDs, are arranged and which cause these light emitting elements to flicker on the basis of image data is conceivable as the optical box 24.

The developing roller 26 is disposed to be close to and to face the photoreceptor 20, and is adapted so that a developing bias voltage is applied between the developing roller 26 and the photoreceptor 20. Accordingly, a developing bias electric field is formed between the developing roller 26 and the photoreceptor 20 and toner having electric charge is transferred to the exposed portion on the photoreceptor 20, so that a visible image is formed.

Meanwhile, the transport unit 18 includes a frame body 51 that has a substantially U-shaped cross section and a substantially flat plate-like housing 50 that holds the frame body 51, a driving roller 30 is rotatably supported at an upper end portion of the frame body 51, and a driven roller 32 is rotatably supported at a lower end portion thereof. Further, a transport belt 34, which can electrostatically attract a recording sheet P, is wound and stretched around the driving roller 30 and the driven roller 32.

Furthermore, transfer rollers 36 are arranged at predetermined positions between the driving roller 30 and the driven roller 32 on the inner surface of the transport belt 34 at predetermined intervals to correspond to the respective colors, and each transfer roller 36 is rotatably supported by the housing 50.

In a case where the cover body 14 is closed (in a case where the cover body 14 is rotated toward the body frame 12 to close the photoreceptors 20 and the like), each transfer roller 36 faces the photoreceptor 20 with the transport belt 34 interposed therebetween and a transfer electric field is formed between the transfer roller 36 and the photoreceptor 20. Accordingly, a toner image (unfixed image) formed on the surface of the photoreceptor 20 is transferred to the recording sheet P that passes while being attracted and transported by the transport belt 34.

Here, the developing units 16 are arranged in a vertical direction in order of, for example, yellow (Y), magenta (M), cyan (C), and black (K) from below so that full-color printing can be performed, and a fixing device 38 is provided on the downstream side of these developing units 16Y to 16K in the transport direction of a recording sheet P (in an upper portion of the body frame 12).

The fixing device 38 includes a heating roller 40 and a pressure roller 42 of which peripheral surfaces face each other and are in pressure contact with each other (nip) at a predetermined pressure, and is adapted to heat and pressurize the unfixed toner images, which are transferred to the recording sheet P, with the heating roller 40 and the pressure roller 42 to fix the toner images to the recording sheet P.

The recording sheet P, which is heated and pressurized by the fixing device 38 (the heating roller 40 and the pressure roller 42) and to which the toner images are fixed, is discharged onto a sheet discharge tray 44. After the transfer of the toner image to the recording sheet P is completed, the surface of each photoreceptor 20 is cleaned by the cleaning member 28 to prepare for the next image forming processing.

Further, an attachable and detachable sheet feeding cassette 46 is provided in a lower portion of the body frame 12. The sheet feeding cassette 46 is adapted to be capable of being pulled out in a direction opposite to a direction in which a recording sheet P is to be sent, so that recording sheets P can be fed as appropriate.

Further, a pair of sheet feeding rollers 48, which sends recording sheets P one by one from the sheet feeding cassette 46, is provided near a distal end portion of the sheet feeding cassette 46, and the recording sheet P sent from the pair of sheet feeding rollers 48 is sent to an attraction transport surface of the transport belt 34 at a predetermined time by a pair of registration rollers 49, and is transported to a position where each color toner image is to be transferred.

First Exemplary Embodiment

With regard to the image forming apparatus 10 having the above-mentioned configuration, a sensor cleaning device 54 according to a first exemplary embodiment and a cleaning member 70 included in the sensor cleaning device 54 will be described below.

As shown in FIG. 2, a brim portion 50A protrudes from an upper end portion of the housing 50 and can face the driving roller 30. The brim portion 50A is provided with a sensor unit 52 including a pair of left and right density sensors 60 (see FIGS. 1 and 3) that faces the transport belt 34 and serves as an example of a sensor detecting the transport belt 34 or the density of a test toner image (a pattern used to detect the density of toner) transferred to and formed on the transport belt 34.

Figure 3:
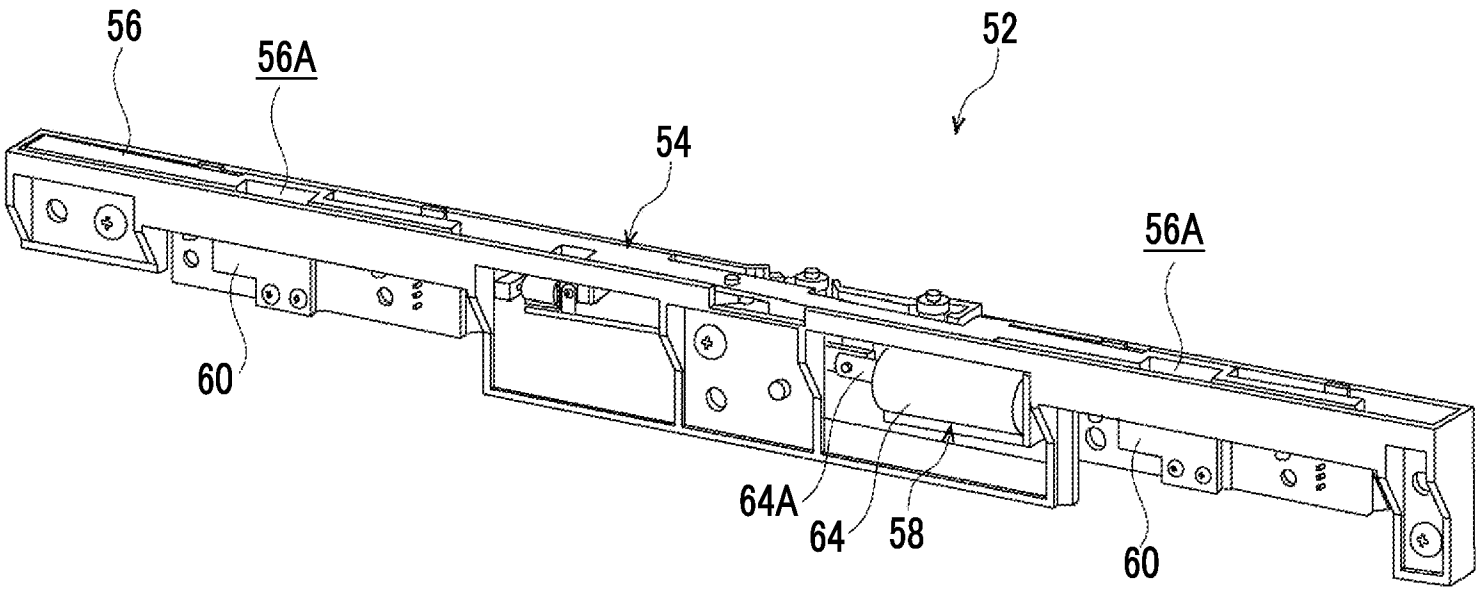
FIG. 3 is a schematic perspective view showing a configuration of a sensor unit according to the present exemplary embodiment.
Figure 4:
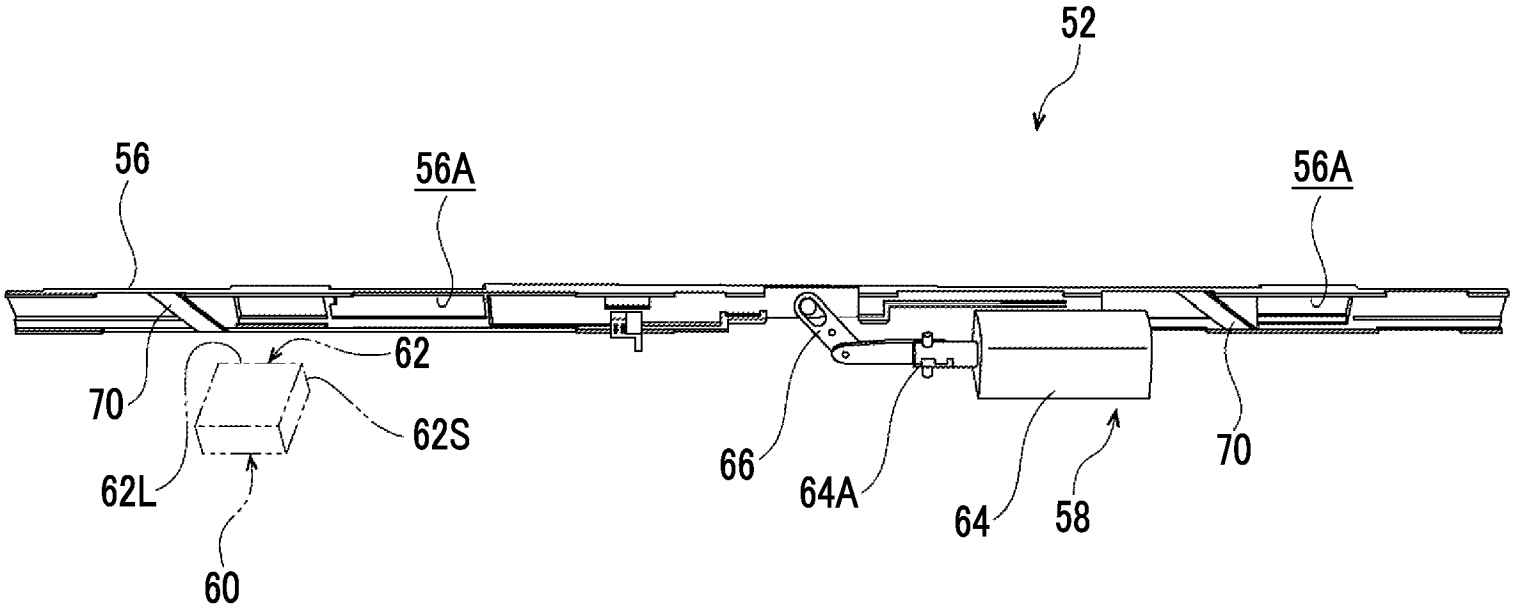
FIG. 4 is a schematic perspective view showing a configuration of a sensor cleaning device according to a first exemplary embodiment.

As shown in FIGS. 3 and 4, a body of each density sensor 60 is formed in the shape of a rectangular box, and a detection surface 62 (see FIG. 5) as an example of a surface facing the transport belt 34 includes long side portions 62L that extend in a longitudinal direction and short side portions 62S that extend in a lateral direction intersecting with the longitudinal direction. Further, the density sensor 60 is adapted to irradiate the toner image, which is present on the transport belt 34, with light from the detection surface 62 at a predetermined angle and to receive light reflected from the toner image via the detection surface 62. The received reflected light is converted into electrical signals and the electrical signals are transmitted to a detection device (not shown), so that the density of toner is detected.

Furthermore, the sensor unit 52 includes a sensor cleaning device 54 that cleans the detection surfaces 62 of the density sensors 60. The sensor cleaning device 54 includes a slide member 56 that is disposed close to the detection surface 62 of the density sensor 60 and moves (slides) in a longitudinal direction of the detection surface 62, and a moving mechanism 58 that moves the slide member 56 to one side in the longitudinal direction (hereinafter, referred to as a "wiping direction") and in a direction opposite to the wiping direction (the other side in the longitudinal direction).

As shown in FIG. 4, the moving mechanism 58 includes a solenoid 64 and a plunger 64A of the solenoid 64 is rotatably mounted on one end of a link member 66 in a longitudinal direction. A middle portion of the link member 66 in the longitudinal direction is rotatably supported, and the other end portion thereof in the longitudinal direction is rotatably mounted on the back surface of the slide member 56 (the surface of the slide member 56 facing the detection surface 62 of the density sensor 60).

Further, the solenoid 64 is adapted to cause the plunger 64A to protrude, for example, in a case where a current flows in the solenoid 64. Accordingly, the link member 66 is rotated about the middle portion thereof in the longitudinal direction and the slide member 56 is moved in the wiping direction. The solenoid 64 is adapted to pull in the plunger 64A in a case where the flow of a current is released, and the link member 66 is rotated about the middle portion thereof in the longitudinal direction in an opposite direction and the slide member 56 is moved in a direction opposite to the wiping direction.

Further, rectangular opening portions 56A, which are the same as or slightly larger than the detection surfaces 62 of the density sensors 60, are formed in the slide member 56, and the detection surfaces 62 of the density sensors 60 are adapted to face the opening portions 56A in normal times. That is, light is applied or received through the opening portions 56A from the detection surfaces 62 of the density sensors 60 in normal times.

Furthermore, cleaning members 70 are attached to the back surface of the slide member 56 on the upstream side of the opening portions 56A in the wiping direction. Each cleaning member 70 includes an inclined portion 72. The inclined portion 72 wipes and cleans the entire detection surface 62 of the density sensor 60 while moving relative to the detection surface 62 of the density sensor 60 in the longitudinal direction of the detection surface 62 of the density sensor 60, and is disposed obliquely to the wiping direction on the downstream side in the wiping direction so that an upstream end portion of the inclined portion 72 in the wiping direction is positioned outside the detection surface 62 of the density sensor 60 in the lateral direction.

Figure 5:
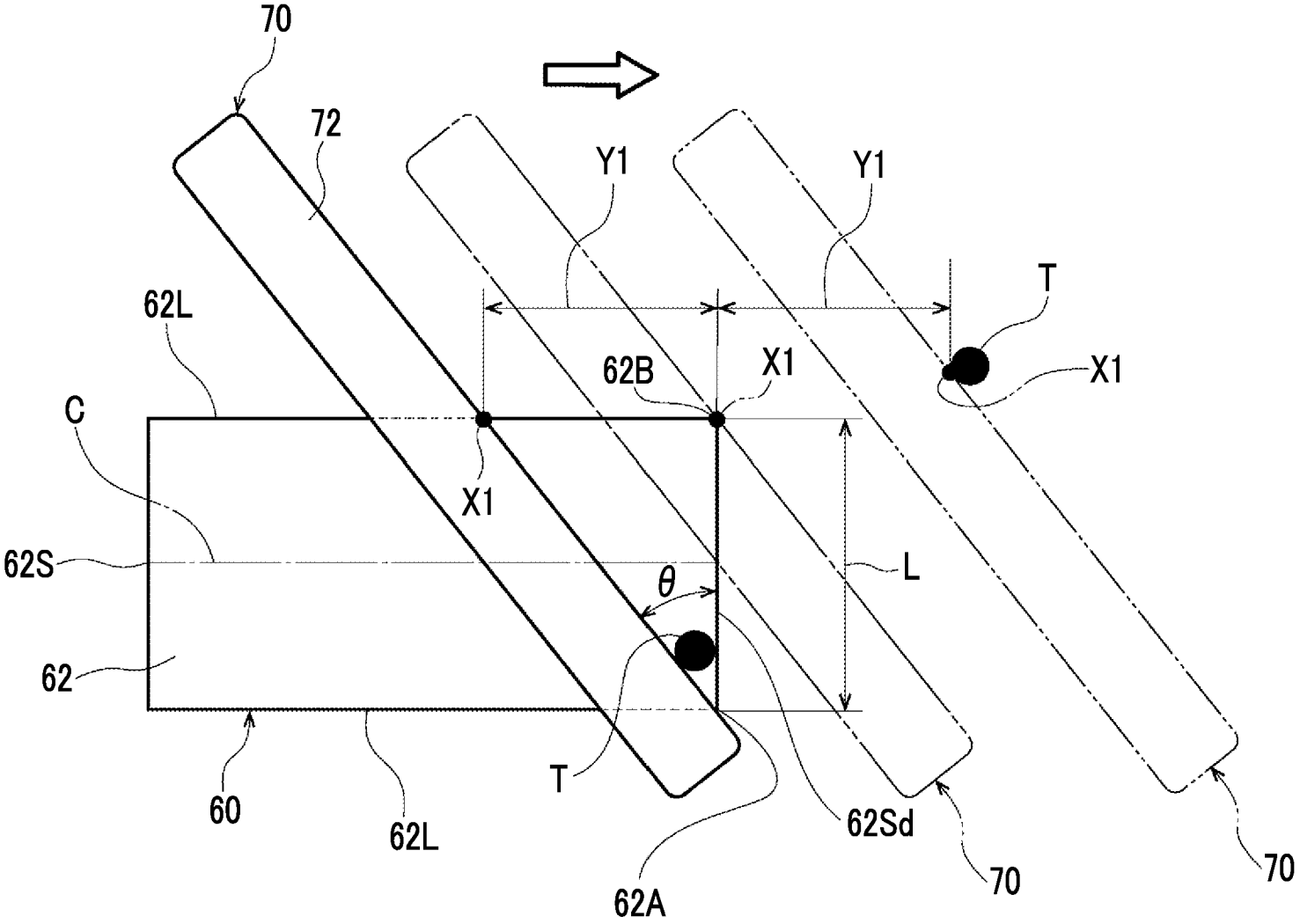
FIG. 5 is a schematic plan view showing a cleaning member of the sensor cleaning device according to the first exemplary embodiment.

Specifically, as shown in FIG. 5, the cleaning member 70 according to the first exemplary embodiment is formed in an elongated rectangular shape that has a direction along the inclined portion 72 as a longitudinal direction. In other words, the cleaning member 70 (the inclined portion 72, more specifically, a portion for wiping the detection surface 62 of the density sensor 60) is formed asymmetrically with respect to a center line C extending in the longitudinal direction of the detection surface 62 of the density sensor 60, and is formed to have a length crossing the detection surface 62 of the density sensor 60. "Elongated" mentioned here means that a ratio of a length in the longitudinal direction to a length in a lateral direction intersecting with the longitudinal direction is, for example, 6 to 12:1, preferably about 8 to 10:1.

Further, the moving mechanism 58 is adapted to move the cleaning member 70 in the wiping direction until at least the inclined portion 72 of the cleaning member 70 passes over one corner 62A of the detection surface 62 of the density sensor 60 on the downstream side in the wiping direction and reaches the other corner 62B thereof, and is more preferably adapted to move the cleaning member 70 up to a position away from a short side portion 62Sd to be described later by, for example, at least the following distance Y1.

That is, in a case where a length of the short side portion 62Sd of the detection surface 62 of the density sensor 60 on the downstream side in the wiping direction is denoted by L and an angle of the inclined portion 72 with respect to the short side portion 62Sd is denoted by θ, the moving mechanism 58 is adapted to move the cleaning member 70 in the wiping direction until an intersection X1 where a middle portion of the inclined portion 72 and one long side portion 62L of the detection surface 62 of the density sensor 60 intersect with each other in a case where the inclined portion 72 of the cleaning member 70 reaches the short side portion 62Sd (corner 62A) is moved up to a position away from the short side portion 62Sd by at least a distance Y1 (=L×tan θ).

Examples of the cleaning member 70 include conductive nylon (registered trademark). Since toner usually has a negative polarity, it is preferable that the cleaning member 70 is made of, for example, a material allowing the detection surface 62 to have a negative polarity via triboelectric charging occurring in a case where the cleaning member 70 wipes (is in sliding contact with) the detection surface 62 of the density sensor 60.

Next, the actions of the cleaning member 70 of the sensor cleaning device 54 according to the first exemplary embodiment having the above-mentioned configuration will be described.

Figure 11A:
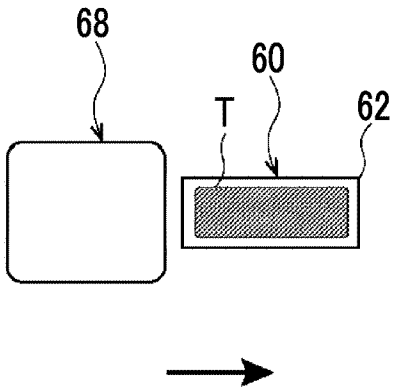
FIGS. 11A, 11B, 11C, and 11D are schematic plan views showing a cleaning member of a sensor cleaning device according to a comparative example.
Figure 11B:
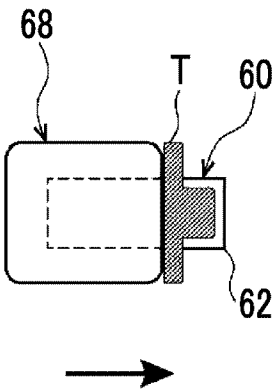
Figure 11C:
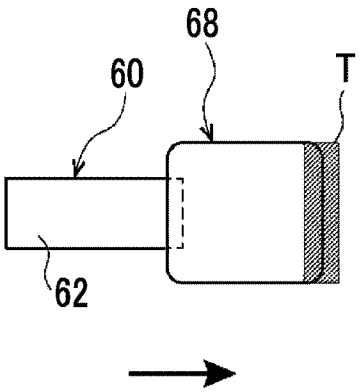

First, a comparative example shown in FIGS. 11A, 11B, 11C, and 11D will be described. As shown in FIG. 11A, a cleaning member 68 according to a comparative example is formed in a substantially square shape larger than the detection surface 62 of the density sensor 60. Accordingly, in a case where the cleaning member 68 is moved in the wiping direction and the detection surface 62 of the density sensor 60 is wiped by the cleaning member 68 as shown in FIGS. 11B and 11C, paper dust, toner (hereinafter, referred to as "residual toner") T, and the like as an example of foreign matters adhering to the detection surface 62 are moved to only the downstream side of the detection surface 62 of the density sensor 60 in the wiping direction with the movement of the cleaning member 68.

Figure 11D:
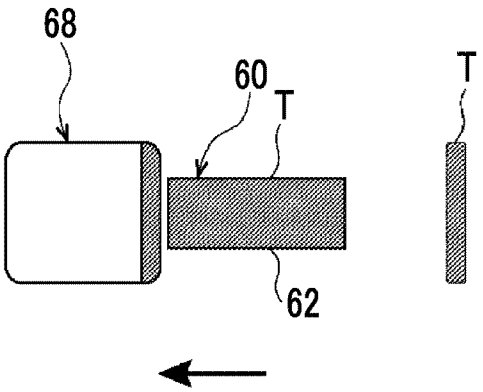

However, a part of the residual toner T adheres to a downstream end portion of the cleaning member 68 in the wiping direction in the case of such a cleaning member 68. Accordingly, as shown in FIG. 11D, at least a part of the residual toner T adhering to the downstream end portion of the cleaning member 68 in the wiping direction is stretched in a case where the cleaning member 68 is returned and moved in a direction opposite to the wiping direction, and re-adheres to the detection surface 62 in a case where the cleaning member 68 passes through the detection surface 62 of the density sensor 60 and returns to an original position.

In contrast, the cleaning member 70 according to the first exemplary embodiment is formed asymmetrically with respect to the center line C extending in the longitudinal direction of the detection surface 62 of the density sensor 60 as shown in FIG. 5, and includes the inclined portion 72 disposed obliquely to the wiping direction so that the upstream end portion of the inclined portion 72 in the wiping direction is positioned outside the detection surface 62 in the lateral direction in a case where the inclined portion 72 wipes and cleans the entire detection surface 62 while moving in the wiping direction.

That is, the cleaning member 70 is formed in an elongated rectangular shape that has a direction along the inclined portion 72 as a longitudinal direction. Further, the moving mechanism 58 is adapted to move the cleaning member 70 in the wiping direction until at least the inclined portion 72 of the cleaning member 70 passes over one corner 62A of the detection surface 62 of the density sensor 60 on the downstream side in the wiping direction and reaches the other corner 62B, more preferably up to a position away from the short side portion 62Sd by, for example, at least the distance Y1.

Figure 6A:
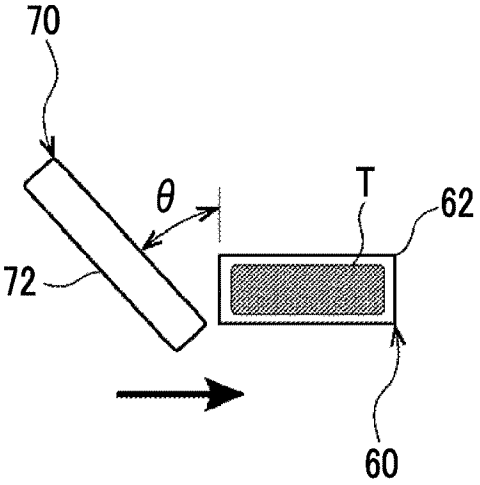
FIGS. 6A, 6B, 6C, and 6D are diagrams showing a cleaning step performed by the cleaning member of the sensor cleaning device according to the first exemplary embodiment.
Figure 6B:
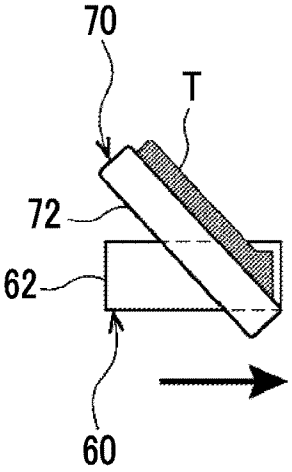
Figure 6C:
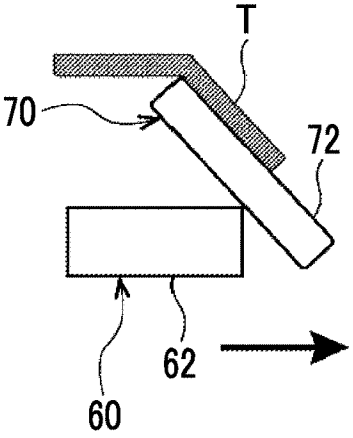

Accordingly, in a case where the cleaning member 70 is moved in the wiping direction as shown in FIG. 6A and the detection surface 62 of the density sensor 60 is wiped by the cleaning member 70 as shown in FIGS. 6B and 6C, the residual toner T adhering to the detection surface 62 is moved (dissipated) to the outside of the detection surface 62 in the lateral direction on the upstream side of the detection surface 62 of the density sensor 60 in the wiping direction (while being guided) along the inclined portion 72 of the cleaning member 70 with the movement of the cleaning member 70.

Figure 6D:
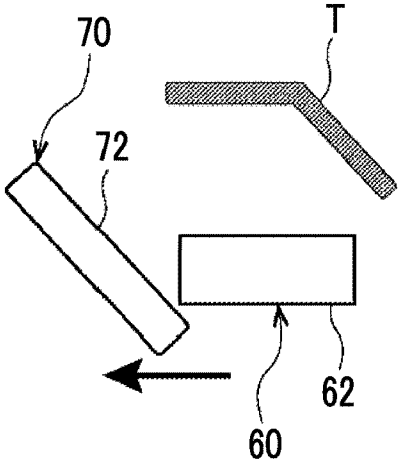

For this reason, as shown in FIG. 6C, it is difficult for the residual toner T to adhere to at least the downstream end portion of the inclined portion 72 of the cleaning member 70, which has wiped the detection surface 62 of the density sensor 60, in the wiping direction. Accordingly, even though the cleaning member 70 is returned and moved in a direction opposite to the wiping direction as shown in FIG. 6D, the occurrence of a problem that a part of the residual toner T re-adheres to the detection surface 62 in a case where the cleaning member 70 passes through the detection surface 62 of the density sensor 60 and returns to the original position is suppressed.

That is, according to the cleaning member 70 of the first exemplary embodiment, the re-adhesion of the residual toner T to the detection surface 62 of the density sensor 60 in a case where the cleaning member 70 passes through the detection surface 62 of the density sensor 60 and returns (returns and moves) to the original position is suppressed as compared to a case where the cleaning member 68 according to the comparative example moves the residual toner T only in the wiping direction to clean the detection surface 62 of the density sensor 60.

Further, since the cleaning member 70 is formed in an elongated rectangular shape that has a direction along the inclined portion 72 as a longitudinal direction, the size of the cleaning member 70 is reduced (the area of the cleaning member 70 is reduced) as compared to the case of, for example, the cleaning member 68 according to the comparative example. Accordingly, the cost of the cleaning member 70 is reduced, and the contact load of the cleaning member 70 applied to the detection surface 62 is reduced. Therefore, since the solenoid 64 having a low output is also sufficient, the cost of the solenoid 64 is also reduced.

Furthermore, as described above, the moving mechanism 58 moves the cleaning member 70 in the wiping direction until at least the inclined portion 72 of the cleaning member 70 passes over one corner 62A of the detection surface 62 of the density sensor 60 on the downstream side in the wiping direction and reaches the other corner 62B. Accordingly, a state where the residual toner T remains adhering to the detection surface 62 of the density sensor 60 is suppressed as compared to a case where the moving mechanism 58 moves the cleaning member 70 only until the inclined portion 72 reaches one corner 62A of the detection surface 62 of the density sensor 60 on the downstream side in the wiping direction.

It is preferable that, as described above, the moving mechanism 58 moves the cleaning member 70 in the wiping direction until the intersection X1 where the middle portion of the inclined portion 72 and one long side portion 62L of the detection surface 62 of the density sensor 60 intersect with each other, for example, in a case where the inclined portion 72 of the cleaning member 70 reaches the short side portion 62Sd (corner 62A) is moved up to a position away from the short side portion 62Sd by at least the distance Y1 ($=L\times\tan\theta$).

According to this, as compared to a case where the moving mechanism 58 moves the cleaning member 70 (intersection X1) in the wiping direction up to only a position within a distance $L\times\tan\theta$ from the short side portion 62Sd, the residual toner T remaining on the detection surface 62 of the density sensor 60 is reliably dissipated to the outside of the detection surface 62 of the density sensor 60 in the lateral direction while the contact load of the cleaning member 70 applied to the detection surface 62 of the density sensor 60 is reduced (see FIG. 5).

Further, according to the image forming apparatus 10 including the sensor cleaning device 54 including such cleaning members 70, the occurrence of poor image quality caused by the detection failure of the density of toner is suppressed as compared to an image forming apparatus including a sensor cleaning device including the cleaning members 68 according to the comparative example. That is, the occurrence of problems, such as erroneous detection and a deviation in density sensitivity, caused by the contamination of detection surface 62 of the density sensor 60 is suppressed.

Second Exemplary Embodiment

Next, cleaning members 80 of a sensor cleaning device 54 according to a second exemplary embodiment will be described. The same components as the components of the first exemplary embodiment will be denoted by the same reference numerals as the reference numerals of the first exemplary embodiment, and the detailed description thereof will be omitted as appropriate.

Each cleaning member 80 according to the second exemplary embodiment includes a plurality of (for example, two) inclined portions 82 and 84. The inclined portions 82 and 84 wipe and clean the entire detection surface 62 of the density sensor 60 while moving relative to the detection surface 62 of the density sensor 60 in the longitudinal direction of the detection surface 62 of the density sensor 60, and are disposed obliquely to the wiping direction on the downstream side in the wiping direction so that upstream end portions of the inclined portions 82 and 84 in the wiping direction are positioned outside the detection surface 62 of the density sensor 60 in the lateral direction.

Figure 7:
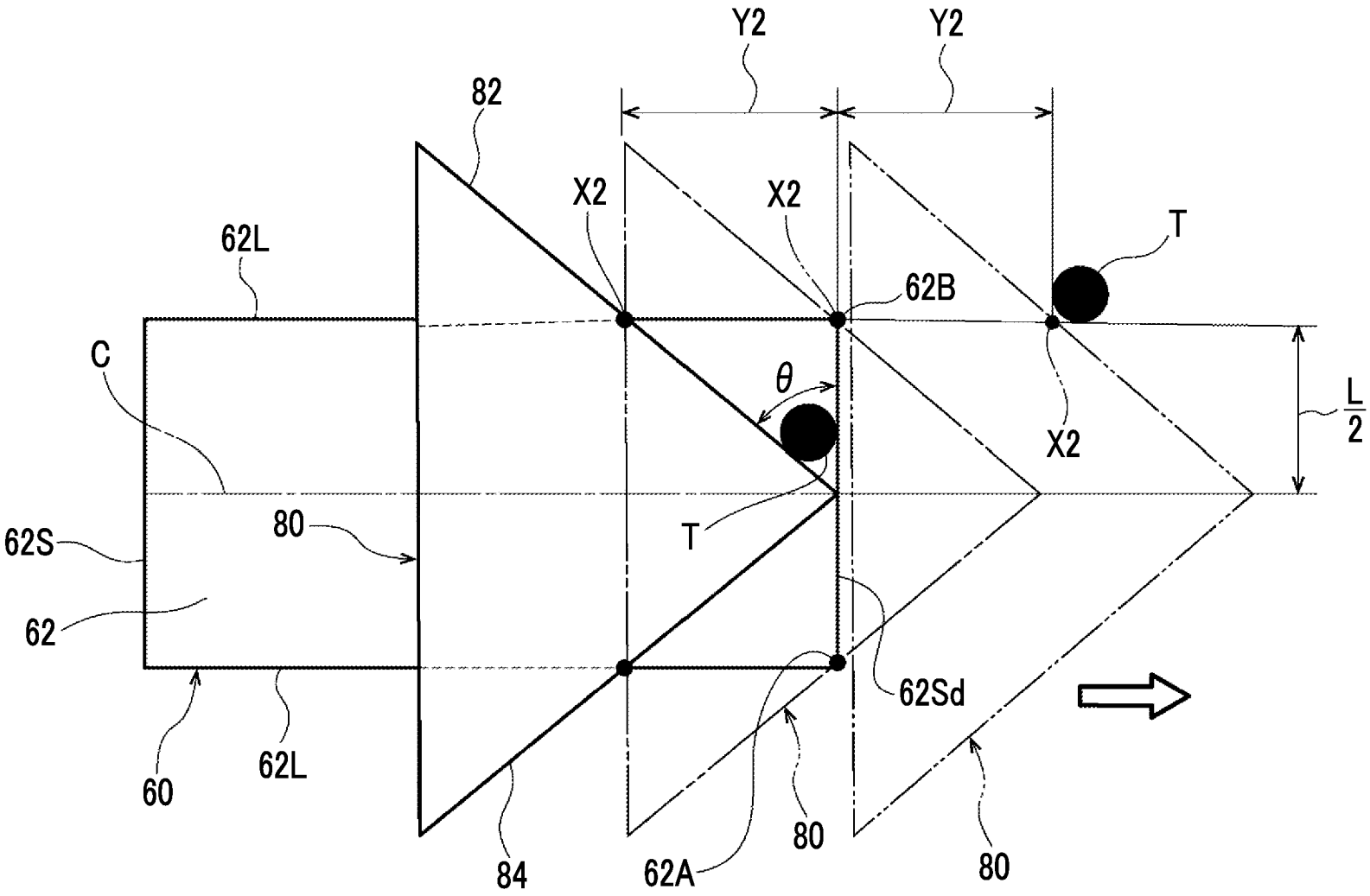
FIG. 7 is a schematic plan view showing a cleaning member of a sensor cleaning device according to a second exemplary embodiment.

Specifically, as shown in FIG. 7, the cleaning member 80 according to the second exemplary embodiment is formed such that the respective inclined portions 82 and 84 are divergent from each other toward the upstream side from the downstream side of the detection surface 62 of the density sensor 60 in the wiping direction, and is formed substantially in the shape of an isosceles triangle. In other words, the cleaning member 80 is formed symmetrically (line-symmetrically) with respect to a center line C extending in the longitudinal direction of the detection surface 62 of the density sensor 60, and is formed to have a length that allows the respective inclined portions 82 and 84 to cross the detection surface 62 of the density sensor 60.

"Symmetrically (line-symmetrically)" mentioned here includes not only "exactly symmetrically (line-symmetrically)" but also "substantially symmetrically (substantially line-symmetrically)" close to "exactly symmetrically (line-symmetrically)". For example, "symmetrically (line-symmetrically)" mentioned here also includes that a difference in length between one inclined portion and the other inclined portion is within ±5%, a difference in inclination angle between one inclined portion and the other inclined portion is within ±2° to 3° degrees, and the like with regard to the respective inclined portions 82 and 84.

Further, the moving mechanism 58 is adapted to move the cleaning member 80 in the wiping direction until at least the inclined portions 82 and 84 of the cleaning member 80 reach the corners 62A and 62B of the detection surface 62 of the density sensor 60 on the downstream side in the wiping direction, respectively, and is more preferably adapted to move the cleaning member 80 up to a position away from the short side portion 62Sd by, for example, at least the following distance Y2.

That is, in a case where a length of the short side portion 62Sd of the detection surface 62 of the density sensor 60 on the downstream side in the wiping direction is denoted by L and an angle of each of the inclined portions 82 and 84 with respect to the short side portion 62Sd is denoted by θ, the moving mechanism 58 is adapted to move the cleaning member 80 in the wiping direction until intersections X2 (since the positions of the intersections X2 are same in the wiping direction, only the intersection X2 on the inclined portion 82 is shown) where middle portions of the respective inclined portions 82 and 84 and long side portions 62L of the detection surface 62 of the density sensor 60 intersect with each other in a case where each of the inclined portions 82 and 84 (apex portion) of the cleaning member 80 reaches the short side portion 62Sd are moved up to positions away from the short side portion 62Sd by at least a distance Y2 (=(L/2)×tan θ).

Next, the actions of the cleaning member 80 of the sensor cleaning device 54 according to the second exemplary embodiment having the above-mentioned configuration will be described. The description of actions common to the first exemplary embodiment will be omitted as appropriate.

The cleaning member 80 according to the second exemplary embodiment is formed symmetrically (line-symmetrically) with respect to the center line C extending in the longitudinal direction of the detection surface 62 of the density sensor 60 as shown in FIG. 7, and includes the plurality of (two) inclined portions 82 and 84 disposed obliquely to the wiping direction so that the upstream end portions of the inclined portions 82 and 84 in the wiping direction are positioned outside the detection surface 62 in the lateral direction in a case where the inclined portions 82 and 84 wipe and clean the entire detection surface 62 while moving in the wiping direction.

That is, the cleaning member 80 is formed substantially in the shape of an isosceles triangle in which the respective inclined portions 82 and 84 are divergent from each other toward the upstream side from the downstream side of the density sensor 60 in the wiping direction. Further, the moving mechanism 58 moves the cleaning member 80 in the wiping direction until at least the inclined portions 82 and 84 of the cleaning member 80 reach the corners 62A and 62B of the detection surface 62 of the density sensor 60 on the downstream side in the wiping direction, respectively, more preferably up to a position away from the short side portion 62Sd by, for example, at least the distance Y2.

Figure 8A:
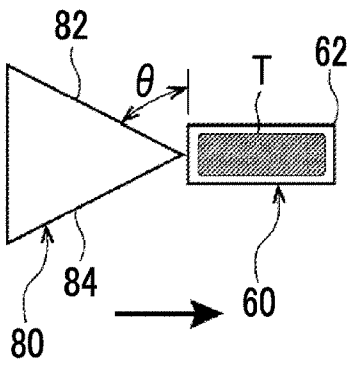
FIGS. 8A, 8B, 8C, and 8D are diagrams showing a cleaning step performed by the cleaning member of the sensor cleaning device according to the second exemplary embodiment.
Figure 8B:
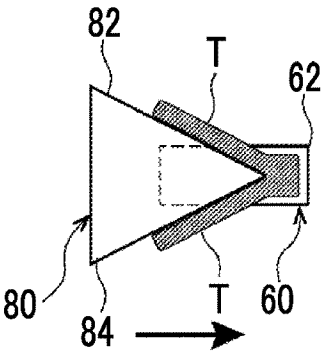
Figure 8C:
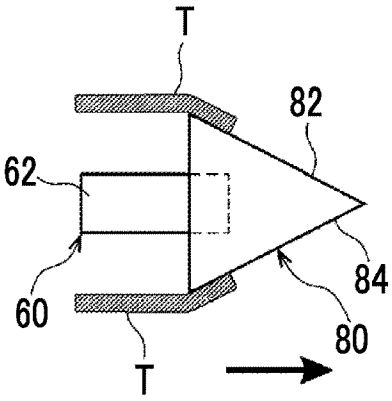

Accordingly, in a case where the cleaning member 80 is moved in the wiping direction as shown in FIG. 8A and the detection surface 62 of the density sensor 60 is wiped by the cleaning member 80 as shown in FIGS. 8B and 8C, residual toner T adhering to the detection surface 62 is moved (dissipated) to the outside of the detection surface 62 in the lateral direction on the upstream side of the detection surface 62 of the density sensor 60 in the wiping direction (while being guided) along each of the inclined portions 82 and 84 of the cleaning member 80 with the movement of the cleaning member 80.

Figure 8D:
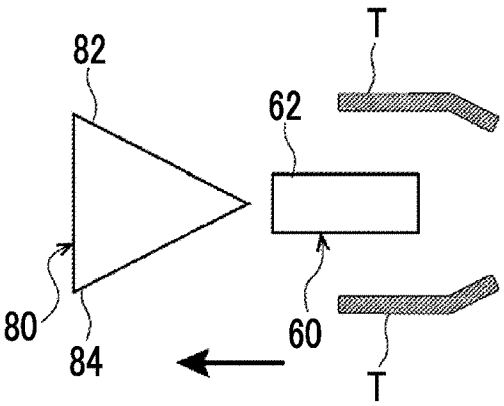

For this reason, as shown in FIG. 8C, it is difficult for the residual toner T to adhere to at least the downstream end portion of each of the inclined portions 82 and 84 of the cleaning member 80, which has wiped the detection surface 62 of the density sensor 60, in the wiping direction. Accordingly, even though the cleaning member 80 is returned and moved in a direction opposite to the wiping direction as shown in FIG. 8D, the occurrence of a problem that a part of the residual toner T re-adheres to the detection surface 62 in a case where the cleaning member 80 passes through the detection surface 62 of the density sensor 60 and returns to the original position is suppressed.

That is, according to the cleaning member 80 of the second exemplary embodiment, the re-adhesion of the residual toner T to the detection surface 62 of the density sensor 60 in a case where the cleaning member 80 passes through the detection surface 62 of the density sensor 60 and returns (returns and moves) to the original position is suppressed as compared to a case where the cleaning member 68 according to the comparative example moves the residual toner T only in the wiping direction to clean the detection surface 62 of the density sensor 60.

Further, since the cleaning member 80 is formed such that the respective inclined portions 82 and 84 are divergent from each other toward the upstream side from the downstream side in the wiping direction, a moving distance required for cleaning is reduced (distance Y2<distance Y1) as compared to the case of, for example, the cleaning member 70 according to the first exemplary embodiment. Accordingly, the size of the sensor cleaning device 54 is reduced, so that the degree of freedom in the layout of the sensor cleaning device 54 is improved.

Furthermore, as described above, the moving mechanism 58 moves the cleaning member 80 in the wiping direction until at least the inclined portions 82 and 84 of the cleaning member 80 reach the corners 62A and 62B of the detection surface 62 of the density sensor 60 on the downstream side in the wiping direction, respectively. Accordingly, a state where the residual toner T remains adhering to the detection surface 62 of the density sensor 60 is suppressed as compared to a case where the moving mechanism 58 moves the cleaning member 80 up to only a position where the respective inclined portions 82 and 84 do not reach the corners 62A and 62B of the detection surface 62 of the density sensor 60 on the downstream side in the wiping direction, respectively.

It is preferable that, as described above, the moving mechanism 58 moves the cleaning member 80 in the wiping direction until the intersections X2 where the middle portions of the respective inclined portions 82 and 84 and the long side portions 62L of the density sensor 60 intersect with each other, for example, in a case where each of the inclined portions 82 and 84 (apex portion) of the cleaning member 80 reaches the short side portion 62Sd are moved up to positions away from the short side portion 62Sd by at least the distance Y2 (=(L/2)×tan θ).

According to this, as compared to a case where the moving mechanism 58 moves the cleaning member 80 (intersections X2) in the wiping direction up to only a position within a distance (L/2)×tan θ from the short side portion 62Sd, the residual toner T remaining on the detection surface 62 of the density sensor 60 is reliably dissipated to the outside of the detection surface 62 of the density sensor 60 in the lateral direction while a moving distance required for cleaning is reduced (see FIG. 7).

Moreover, since the cleaning member 80 is formed such that the respective inclined portions 82 and 84 are divergent from each other toward the upstream side from the downstream side in the wiping direction and is formed line-symmetrically with respect to the center line C, substantially the same amount of residual toner T is dissipated to both sides outside the detection surface 62 of the density sensor 60 in the lateral direction as compared to the case of the cleaning member 70 according to the first exemplary embodiment (see FIG. 8D).

First Modification Example

Figure 9:
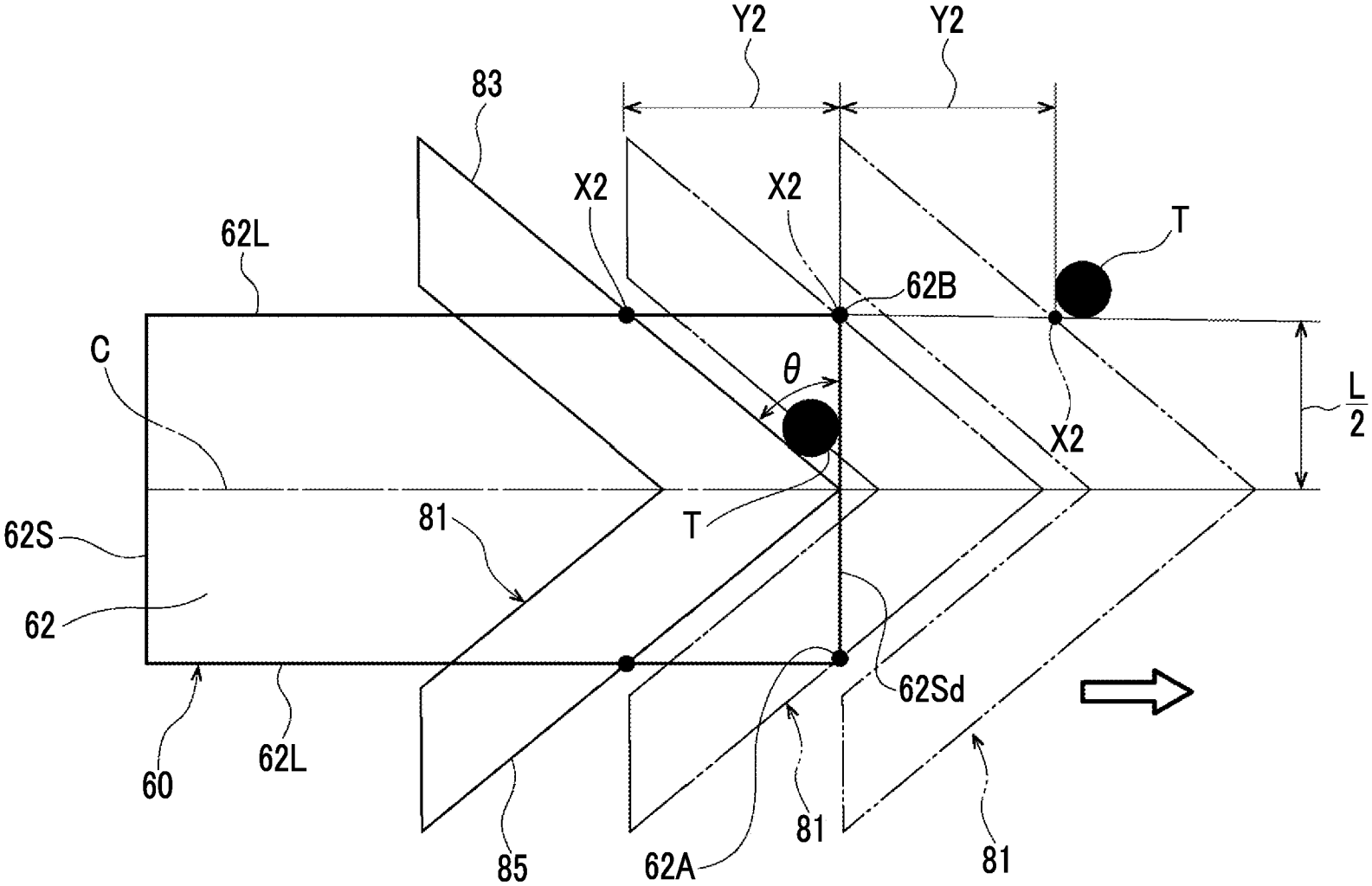
FIG. 9 is a schematic plan view showing a cleaning member of a sensor cleaning device according to a first modification example of the second exemplary embodiment.

A cleaning member 81 having a shape shown in FIG. 9 may be used in the second exemplary embodiment. That is, the cleaning member 81 is formed substantially in a ">" shape of which a downstream end portion in the wiping direction is an apex (is formed in a shape in which a middle portion of the cleaning member 80 in the lateral direction on the upstream side in the wiping direction is cut out substantially in the shape of an isosceles triangle), and includes a plurality of (two) inclined portions 83 and 85 that are divergent from each other toward the upstream side from the downstream side of the detection surface 62 of the density sensor 60 in the wiping direction.

According to the cleaning member 81 formed in such a shape, the same effects as the cleaning member 80 are obtained and the same effects as the cleaning member 70 are also obtained. That is, since the cleaning member 81 is formed such that the plurality of inclined portions 83 and 85 are divergent from each other toward the upstream side from the downstream side in the wiping direction, a moving distance required for cleaning is reduced as compared to the case of, for example, the cleaning member 70 according to the first exemplary embodiment. Accordingly, the size of the sensor cleaning device 54 is reduced, so that the degree of freedom in the layout of the sensor cleaning device 54 is improved.

Further, since the cleaning member 81 is formed in a shape in which a middle portion of the cleaning member 80 in the lateral direction on the upstream side in the wiping direction is cut out substantially in the shape of an isosceles triangle, the size of the cleaning member 81 is reduced (the area of the cleaning member 81 is reduced) as compared to the case of, for example, the cleaning member 68 according to the comparative example. Accordingly, the cost of the cleaning member 81 is reduced, and the contact load of the cleaning member 81 applied to the detection surface 62 is reduced. Therefore, since the solenoid 64 having a low output is also sufficient, the cost of the solenoid 64 is also reduced.

Second Modification Example

Figure 10:
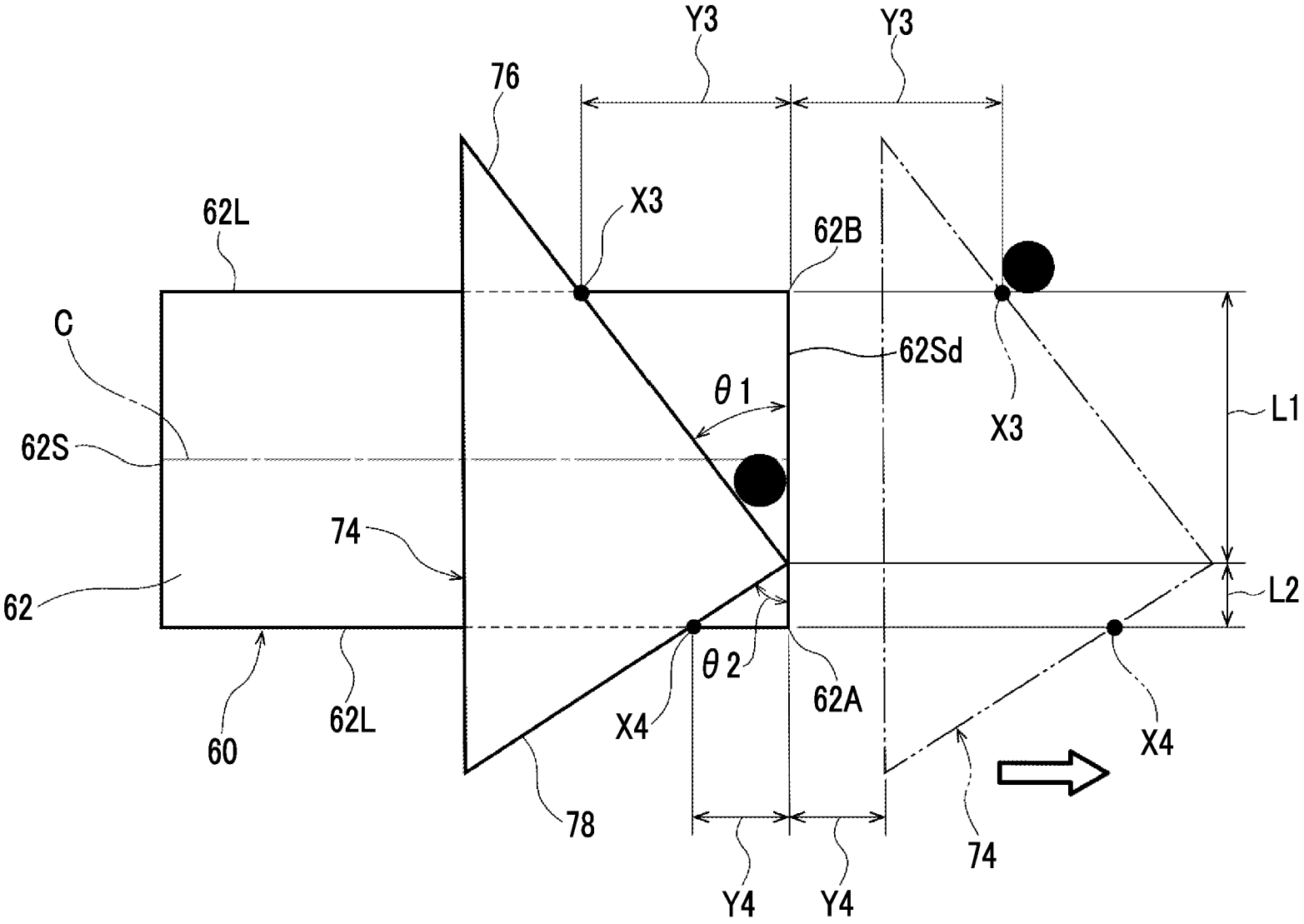
FIG. 10 is a schematic plan view showing a cleaning member of a sensor cleaning device according to a second modification example of the second exemplary embodiment.

Further, a cleaning member 74 having a shape shown in FIG. 10 may be used in the second exemplary embodiment. That is, the cleaning member 74 is formed in the shape of a triangle of which three sides have lengths different from each other, and includes a plurality of (two) inclined portions 76 and 78 that are divergent from each other toward the upstream side from the downstream side of the detection surface 62 of the density sensor 60 in the wiping direction. In other words, the cleaning member 74 is formed asymmetrically with respect to the center line C extending in the longitudinal direction of the detection surface 62 of the density sensor 60, and is formed to have a length that allows the respective inclined portions 76 and 78 to cross the detection surface 62 of the density sensor 60.

Furthermore, in a case where each of inclined portions 76 and 78 (apex portion) of the cleaning member 74 reaches the short side portion 62Sd, the length of a part of the short side portion 62Sd between the apex portion and the corner 62B is denoted by L1, the length of the other part of the short side portion 62Sd between the apex portion and the corner 62A is denoted by L2, the angle of the inclined portion 76 with respect to the short side portion 62Sd is denoted by θ1, and the angle of the inclined portion 78 with respect to the short side portion 62Sd is denoted by θ2. In this case, the moving mechanism 58 is adapted to move the cleaning member 74 in the wiping direction until an intersection X3 where a middle portion of the inclined portion 76 and one long side portion 62L of the detection surface 62 of the density sensor 60 intersect with each other is moved up to a position away from the short side portion 62Sd by at least a distance Y3 (=L1×tan θ1) or an intersection X4 where a middle portion of the inclined portion 78 and the other long side portion 62L of the detection surface 62 of the density sensor 60 intersect with each other is moved up to a position away from the short side portion 62Sd by at least a distance Y4 (=L2×tan θ2).

That is, the moving mechanism 58 is adapted to move the cleaning member 74 in the wiping direction by a distance equal to or larger than a larger one of the distance Y3 and the distance Y4. Since the distance Y3 is larger than the distance Y4 in the case of the cleaning member 74 shown in FIG. 10, the cleaning member 74 is moved in the wiping direction up to a position away from the short side portion 62Sd by at least the distance Y3. Accordingly, residual toner T remaining on the detection surface 62 of the density sensor 60 is reliably dissipated to the outside of the detection surface 62 of the density sensor 60 in the lateral direction (see FIG. 10).

The sensor cleaning device 54 according to the present exemplary embodiment has been described above with reference to the drawings, but the sensor cleaning device 54 according to the present exemplary embodiment is not limited to the sensor cleaning device shown in the drawings and the design of the sensor cleaning device 54 can be changed as appropriate without departing from the scope of the present invention. For example, the shape of the cleaning member according to the present exemplary embodiment is not limited to the shapes of the cleaning members 70, 74, 80, and 81 shown in the drawings.

Further, the moving mechanism 58 is not limited to a configuration including the solenoid 64 shown in the drawings. For example, the moving mechanism 58 may be adapted so that the slide member 56 moves (slides) in conjunction with the opening and closing of the cover body 14. Since the solenoid 64 is not provided in the case of such a configuration, the manufacturing cost of the sensor cleaning device 54 is reduced.

Furthermore, the density sensors 60 may be disposed to face the surface of the photoreceptor 20 without being disposed to face the transport belt 34. Moreover, the detection surface 62 of the density sensor 60 may have the corners 62A and 62B formed at least on the downstream side thereof in the wiping direction, and may not have corners formed on the upstream side thereof in the wiping direction (for example, the upstream side of the detection surface 62 in the wiping direction may be formed in a substantially arc shape).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sensor cleaning device comprising:

a cleaning member including an inclined portion that wipes and cleans an entire surface of a sensor, which includes a long side portion extending in a longitudinal direction and a short side portion extending in a lateral direction intersecting with the longitudinal direction, while moving relative to the surface of the sensor in the longitudinal direction of the surface of the sensor and is disposed obliquely to a wiping direction so that an upstream end portion of the inclined portion in the wiping direction is positioned outside the surface of the sensor in the lateral direction; and a moving mechanism that moves the cleaning member in the wiping direction and in a direction opposite to the wiping direction.

2. The sensor cleaning device according to claim 1, wherein the cleaning member is formed asymmetrically with respect to a center line extending in the longitudinal direction of the surface of the sensor, and the moving mechanism moves the cleaning member in the wiping direction until at least the inclined portion of the cleaning member passes over one corner of the surface of the sensor on a downstream side in the wiping direction and reaches the other corner of the surface of the sensor.

3. The sensor cleaning device according to claim 2, wherein the cleaning member is formed in a rectangular shape that has a direction along the inclined portion as a longitudinal direction.

4. The sensor cleaning device according to claim 3, wherein in a case where a length of a short side portion of the surface of the sensor on the downstream side in the wiping direction is denoted by L and an angle of the inclined portion with respect to the short side portion is denoted by θ, the moving mechanism moves the cleaning member in the wiping direction until an intersection where a middle portion of the inclined portion and the long side portion of the surface of the sensor intersect with each other in a case where the inclined portion of the cleaning member reaches the short side portion is moved up to a position away from the short side portion by at least $L \times \tan \theta$.

5. An image forming apparatus comprising:

a sensor that detects a density of a pattern used to detect a density of toner; and the sensor cleaning device according to claim 4 that wipes and cleans the surface of the sensor.

6. An image forming apparatus comprising:

a sensor that detects a density of a pattern used to detect a density of toner; and the sensor cleaning device according to claim 2 that wipes and cleans the surface of the sensor.

7. An image forming apparatus comprising:

a sensor that detects a density of a pattern used to detect a density of toner; and the sensor cleaning device according to claim 3 that wipes and cleans the surface of the sensor.

8. The sensor cleaning device according to claim 1, wherein the cleaning member is formed symmetrically with respect to a center line extending in the longitudinal direction of the surface of the sensor and includes a plurality of inclined portions, and the moving mechanism moves the cleaning member in the wiping direction until at least the plurality of inclined portions of the cleaning member reach corners of the surface of the sensor on a downstream side in the wiping direction, respectively.

9. The sensor cleaning device according to claim 8, wherein the cleaning member is formed such that the plurality of inclined portions are divergent from each other toward an upstream side from the downstream side of the surface of the sensor in the wiping direction.

10. The sensor cleaning device according to claim 9, wherein in a case where a length of a short side portion of the surface of the sensor on the downstream side in the wiping direction is denoted by L and an angle of the inclined portion with respect to the short side portion is denoted by θ, the moving mechanism moves the cleaning member in the wiping direction until an intersection where a middle portion of the inclined portion and the long side portion of the surface of the sensor intersect with each other in a case where the inclined portion of the cleaning member reaches the short side portion is moved up to a position away from the short side portion by at least $(L/2) \times \tan \theta$.

11. An image forming apparatus comprising:

a sensor that detects a density of a pattern used to detect a density of toner; and the sensor cleaning device according to claim 10 that wipes and cleans the surface of the sensor.

12. An image forming apparatus comprising:

a sensor that detects a density of a pattern used to detect a density of toner; and the sensor cleaning device according to claim 8 that wipes and cleans the surface of the sensor.

13. An image forming apparatus comprising:

a sensor that detects a density of a pattern used to detect a density of toner; and the sensor cleaning device according to claim 9 that wipes and cleans the surface of the sensor.

14. An image forming apparatus comprising:

a sensor that detects a density of a pattern used to detect a density of toner; and the sensor cleaning device according to claim 1 that wipes and cleans the surface of the sensor.

* * * * *